US009877558B1

(12) United States Patent
Harstvedt

(10) Patent No.: US 9,877,558 B1
(45) Date of Patent: Jan. 30, 2018

(54) CUSTOMIZABLE BAG

(71) Applicant: Jon G. Harstvedt, Santa Rosa Beach, FL (US)

(72) Inventor: Jon G. Harstvedt, Santa Rosa Beach, FL (US)

( * ) Notice: Subject to any disclaimer, the term of this patent is extended or adjusted under 35 U.S.C. 154(b) by 0 days.

(21) Appl. No.: 15/594,759

(22) Filed: May 15, 2017

Related U.S. Application Data

(63) Continuation-in-part of application No. 14/795,107, filed on Jul. 9, 2015, now abandoned.

(60) Provisional application No. 62/022,756, filed on Jul. 10, 2014.

(51) Int. Cl.

| | |
|---|---|
| ***A45F 3/04*** | (2006.01) |
| ***A45C 13/08*** | (2006.01) |
| ***A45C 13/00*** | (2006.01) |
| ***A45C 13/02*** | (2006.01) |
| ***A45C 13/42*** | (2006.01) |
| ***B65D 33/00*** | (2006.01) |
| *A45F 3/00* | (2006.01) |

(52) U.S. Cl.
CPC ..... *A45C 13/08* (2013.01); *A45C 13/008* (2013.01); *A45C 13/02* (2013.01); *A45C 13/42* (2013.01); *B65D 33/004* (2013.01); *A45C 2013/026* (2013.01); *A45C 2200/10* (2013.01); *A45F 3/04* (2013.01); *A45F 2003/003* (2013.01)

(58) Field of Classification Search
CPC ..... A45F 3/04; A45F 2003/003; A45C 13/08; A45C 2200/10; B65D 33/004
See application file for complete search history.

(56) References Cited

U.S. PATENT DOCUMENTS

| | | | | | |
|---|---|---|---|---|---|
| 2,436,579 | A * | 2/1948 | Kritchman | B42D 3/08 | 150/104 |
| 3,556,187 | A * | 1/1971 | Speakes | A45C 13/08 | 150/104 |
| 3,575,226 | A * | 4/1971 | Chapman | A45C 13/08 | 150/104 |
| 3,818,963 | A * | 6/1974 | Whitman | A45C 13/42 | 383/106 |
| 4,022,261 | A * | 5/1977 | Russell | A45C 3/06 | 150/101 |
| 4,085,873 | A * | 4/1978 | Schweitzer | A45C 7/0077 | 224/153 |

(Continued)

*Primary Examiner* — Justin Larson
(74) *Attorney, Agent, or Firm* — Global Intellectual Property Agency, LLC; Daniel Enea

(57) ABSTRACT

A customizable bag for interchangeably displaying photos, business logos, and images of characters, such as superheroes, sports teams, celebrities, and the like on the exterior a bag. The customizable bag includes a main compartment and one or more secondary compartments for carrying objects therein. The bag further includes one or more pockets disposed within a main compartment or a secondary compartment, such that the exterior surface of the bag serves as a front wall for a pocket. The pocket includes a transparent window disposed on the front wall thereof, wherein the pocket can receive an insert having an image thereon. An opening is disposed on the pocket that enables the insert to be inserted into the pocket, wherein the image is then displayed through the transparent window. The opening is closable by a fastener in order to protect the insert from becoming wet.

6 Claims, 5 Drawing Sheets

(56) References Cited

U.S. PATENT DOCUMENTS 4,236,559 A * 12/1980 Archbold ..... A45C 3/00 190/111
4,243,340 A * 1/1981 MacGregor ..... A45C 13/42 190/102
4,625,337 A * 12/1986 Zahn ..... A41D 3/04 2/247
4,924,613 A * 5/1990 Levin ..... A41D 27/08 2/247
5,222,642 A * 6/1993 Solarz ..... A45C 13/08 224/191
5,632,044 A * 5/1997 Sloot ..... A41D 13/01 2/102
5,639,004 A * 6/1997 Carlton ..... A45C 9/00 190/125
D381,704 S * 7/1997 Li ..... D21/483
5,860,769 A * 1/1999 Seligman ..... A44B 11/263 224/264
6,173,837 B1 * 1/2001 Marconi ..... A45C 3/08 190/125
6,220,318 B1 * 4/2001 Pinti ..... A45C 3/06 150/103
6,231,233 B1 * 5/2001 Orce ..... A45C 13/08 150/101
D457,306 S * 5/2002 Szyf ..... D3/216
6,393,745 B1 * 5/2002 Miki ..... G09F 27/00 224/627
6,484,917 B1 * 11/2002 Haber ..... A45F 3/04 224/153
6,520,607 B2 * 2/2003 Pfaff ..... G06F 1/1616 206/457
7,296,665 B2 * 11/2007 Morszeck ..... A45C 5/02 150/104
7,571,495 B2 * 8/2009 Emeth ..... A41D 27/08 2/115
D639,057 S * 6/2011 Presman ..... D3/279
8,028,730 B2 * 10/2011 Whiting ..... A45C 13/02 150/104
8,157,068 B2 * 4/2012 Sapyta ..... A45C 7/0054 190/107
8,281,970 B2 10/2012 Demskey
8,282,235 B2 10/2012 Gilligan
D670,915 S * 11/2012 Jablin ..... D3/321
D673,362 S * 1/2013 Presman ..... D3/216
2002/0153402 A1 10/2002 Gausling et al.
2002/0185395 A1 12/2002 Lindamood
2003/0034369 A1 * 2/2003 Haber ..... A45F 3/04 224/579
2004/0076000 A1 * 4/2004 Thorp ..... A45F 3/04 362/154
2006/0027292 A1 * 2/2006 Persic ..... A45C 13/08 150/105
2006/0163303 A1 * 7/2006 Trutanich ..... A45F 3/04 224/576
2008/0237288 A1 * 10/2008 Hamilton ..... A45C 13/18 224/645
2009/0294499 A1 * 12/2009 McKinney ..... A45C 13/08 224/576
2013/0082077 A1 4/2013 Millman et al.
2014/0001079 A1 * 1/2014 Green ..... A45C 13/02 206/577
2014/0061273 A1 3/2014 Bullivant et al.
2015/0157113 A1 * 6/2015 Anelevitz ..... A45F 3/04 224/576
2016/0007719 A1 * 1/2016 Harstvedt ..... A45C 13/08 224/645

* cited by examiner

CUSTOMIZABLE BAG

CROSS REFERENCE TO RELATED APPLICATIONS

This application claims the benefit of U.S. patent application Ser. No. 14/795,107 filed on Jul. 9, 2015, which claims the benefit of U.S. Provisional Application No. 62/022,756 filed on Jul. 10, 2014, each hereby incorporated by reference in their entirety to provide continuity of disclosure.

BACKGROUND OF THE INVENTION

The present invention relates to customizable bags. More specifically, the present invention provides a customizable bag comprising one or more pockets disposed on the bag, wherein the pockets are adapted to receive an insert therein. The pockets include a window composed of a transparent material adapted to display the insert therethrough.

Many children, teenagers, and college students carry rolling bags, backpacks, and the like to school in order to hold books, school supplies, and various other items. Many of these individuals use their bag to express their interests and style. For example, children enjoy showing off their backpacks with their favorite superheroes, celebrities, and the like. Other individuals prefer to display an interesting pattern or their favorite sports team on the outside of their bag. Additionally, adults may need to show support for their workplace at tradeshows, conventions, and the like by having a company logo displayed on the exterior of their bag.

Unfortunately, this requires the purchase of several bags, which is expensive and impractical for many individuals, especially parents with multiple children. Some parents choose to spend excessive amounts of money on multiple backpacks in order to keep their children happy. Businesses have bags made using a specific logo for a specific event, wherein the bags are eventually disposed of once the event has passed. Therefore, there exists a need in the prior art for a bag that allows a user to interchangeably display various logos, characters, and the like thereon.

Devices have been disclosed in the prior art that relate to bags having a window. These include devices that have been patented and published in patent application publications. These devices generally relate to backpacks comprising a window for viewing the interior of the bag, such as U.S. Patent Application Publication Number 2013/0082077 to Millman et al., U.S. Patent Application Publication Number 2002/0153402 to Gausling et al., and U.S. Patent Application Publication Number 2002/0185395 to Lindamood. Another device generally relates to a window designed to expose sunlight to solar panels disposed on the interior of the backpack, such as U.S. Patent Application Publication Number 2014/0061273 to Bullivant et al.

These prior art devices have several known drawbacks. The devices in the prior art fail to provide a bag comprising an insert or a bag capable of holding an insert therein for display through a transparent window. Despite the devices comprising a window, the devices fail to provide a mechanism that enables an insert to become part of the exterior of the bag by allowing the insert to be positioned flush against the window. Thus, the prior art devices fail to disclose a customizable bag that can be used to interchangeably display an insert in order to customize the appearance of a bag.

In light of the devices disclosed in the prior art, it is submitted that the present invention substantially diverges in design elements from the prior art and consequently it is clear that there is a need in the art for an improvement to existing customizable bags. In this regard the instant invention substantially fulfills these needs.

SUMMARY OF THE INVENTION

In view of the foregoing disadvantages inherent in the known types of customizable bags now present in the prior art, the present invention provides a new customizable bag wherein the same can be utilized for providing convenience for the user when customizing a bag by interchangeably displaying various characters, logos, and the like on the exterior thereof.

It is therefore an object of the present invention to provide a new and improved customizable bag that has all of the advantages of the prior art and none of the disadvantages.

It is another object of the present invention to provide a customizable bag comprising an exterior surface and a main compartment.

Another object of the present invention is to provide a customizable bag further comprising one or more pockets disposed on the bag, wherein each pocket comprises a front wall having a transparent window, a rear wall, and an opening adapted to provide access to the interior of the pocket.

Yet another object of the present invention is to provide a customizable bag wherein the pocket is adapted to receive an insert through the opening and display the insert through transparent window.

Yet another object of the present invention is to provide a customizable bag wherein the opening is closable by a fastener, such as hook and loop material or a zipper.

Yet another object of the present invention is to provide a customizable bag further comprising an insert that is disposed in the pocket for viewing through the front wall and is interchangeable with other inserts.

Yet another object of the present invention is to provide a customizable bag further comprising one or more secondary compartments adapted to hold objects therein.

Another object of the present invention is to provide a customizable bag that may be readily fabricated from materials that permit relative economy and are commensurate with durability.

Other objects, features and advantages of the present invention will become apparent from the following detailed description taken in conjunction with the accompanying drawings.

BRIEF DESCRIPTION OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
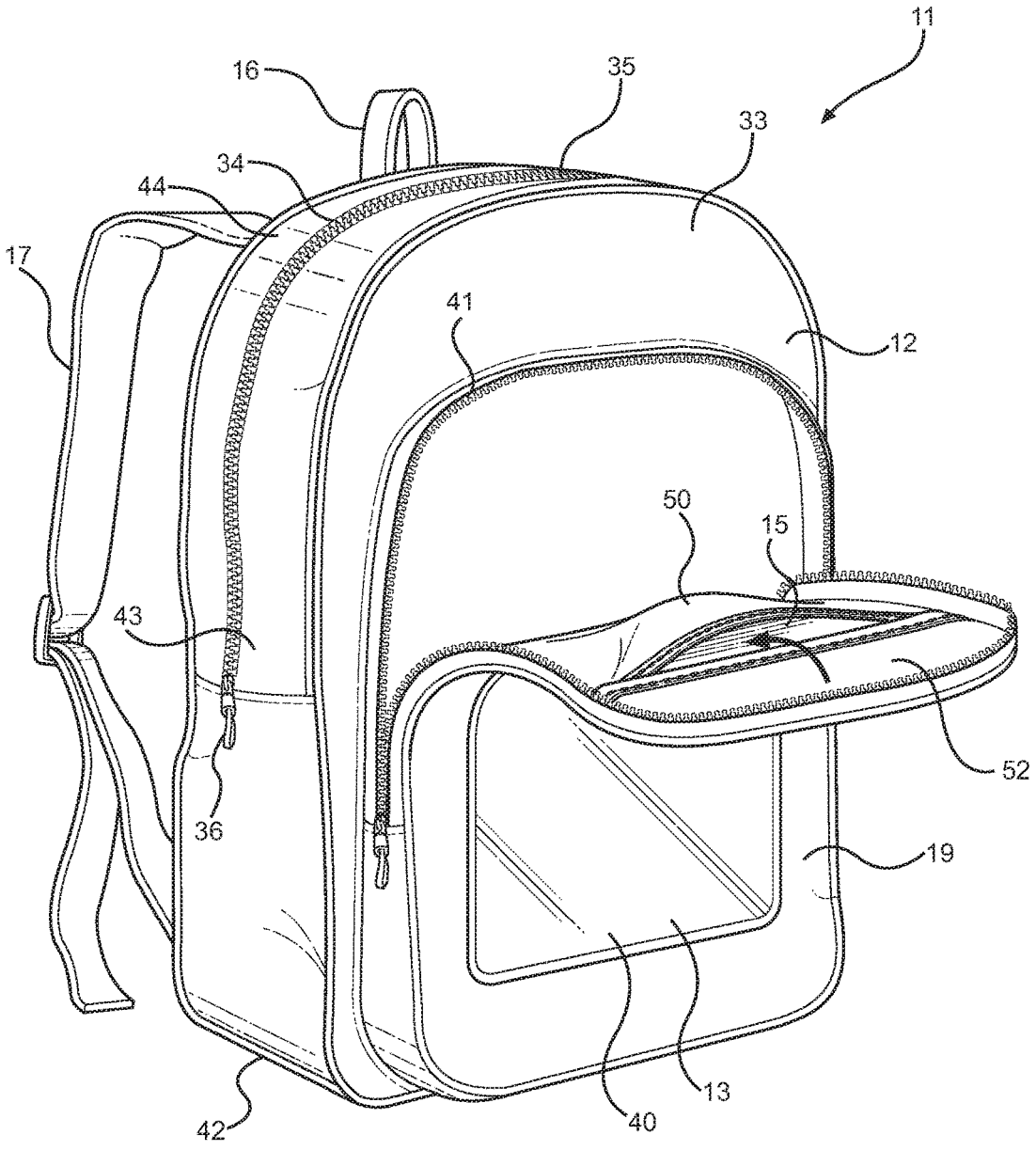
FIG. 1 shows a perspective view of an embodiment of the customizable bag.

Reference is made herein to the attached drawings. Like reference numerals are used throughout the drawings to depict like or similar elements of the customizable bag. For the purposes of presenting a brief and clear description of the present invention, the preferred embodiment will be discussed as used for customizing a bag by interchangeably displaying various characters, logos, and the like on the exterior thereof. The figures are intended for representative purposes only and should not be considered to be limiting in any respect.

Referring now to FIG. 1, there is shown a perspective view of an embodiment of the customizable bag. The customizable bag 11 is adapted to allow a user to interchangeably display an insert (as referenced in FIG. 2, 14 and FIG. 5, 32) on an exterior of the bag 12, wherein the insert comprises an image thereon, such as a television character, superhero, sports team, business logo, a photograph of family or friends, and the like. The insert allows a user to tailor the appearance of his or her bag 12 to a user's desired style, interests, to promote various businesses, and the like. Thus, a user is able to use a single bag 12 to perform various functions and to express their current interests and style. When a user becomes tired and disinterested in the current exterior of his or her bag 12, he or she removes the insert and replaces it with another.

The customizable bag 11 comprises a bag 12 having an exterior surface and a main compartment 34, wherein the main compartment 34 is adapted to receive objects therein. In some embodiments, the customizable bag 11 comprises one or more secondary compartments 41 adapted to receive objects therein. The customizable bag 11 further comprises one or more pockets 13 disposed within a main compartment 34 or a secondary compartment 41, such that the exterior surface of the bag serves as a front wall for a pocket. Each pocket 13 includes a transparent window 40 adapted to display the insert therethrough. In the illustrated embodiment, the customizable bag 11 resembles a backpack. However, other embodiments include various types of bags, such as a suitcase, a tote bag, a duffel bag, a messenger bag, a rolling bag, a briefcase, a shoulder bag, among others.

The bag 12 includes a pair of parallel shoulder straps 17, wherein each shoulder strap 17 is disposed on an opposing side of the rear wall. The shoulder straps 17 are adapted to be positioned over a user's shoulders in order for the bag 12 to be worn on the user's back. The bag 12 further comprises a U-shaped handle 16 disposed on the upper end of the rear wall in order for the bag 12 to be hung on a support surface or provide an alternative carrying position for the user.

The main compartment 34 of the bag 12 comprises a base 42, one or more sidewalls 43, an upper end 44, and an opening 35 that provides access thereto. The opening 35 is disposed along the lateral sides and the upper end 44 of the bag 12. However, in other embodiments the opening 35 can be disposed anywhere along the main compartment 34 that is accessible to the user. The opening 35 is closable by any suitable fastener, such as a water-resistant zipper 36. The water-resistant zipper 36 is adapted to protect the insert 14 from becoming wet and disfigured.

One or more secondary compartments 41 are disposed on the bag 12 in order to provide additional capacity to hold objects therein. The secondary compartment 41 comprises a base, one or more sidewalls, and an upper end. The interior of the secondary compartment 41 is accessible via an opening that is closable using any suitable fastener, such as a water-resistant zipper 18. The water-resistant zipper 18 is adapted to protect the insert 14 from becoming wet and disfigured. The fastener may be disposed along the open upper end of the secondary compartment 41, and extend from a midsection of the first sidewall, across the open upper end of the secondary compartment, and terminating at a midsection of the second sidewall. In the illustrated embodiment, a secondary compartment 41 is disposed on a front wall 33 of the main compartment 34. The front wall 33 of the main compartment 34 serves as a rear wall of the secondary compartment 41. In other embodiments, the secondary compartment 41 can be disposed in any position on the bag 12, including on the lower end or the lateral sides thereof.

The customizable bag 11 further comprises one or more pockets 13 disposed within a main compartment 34 or a secondary compartment 41 of the bag 12, wherein the pocket 13 is adapted to receive an insert therein. In the illustrated embodiment, a pocket 13 is disposed on the interior of the secondary compartment 41. The front wall of the secondary compartment 41 comprises the exterior of the bag 12 and, therefore serves as a front wall of the pocket 13. In other embodiments, the pockets 13 can be disposed on any area on the customizable bag 11, including the sidewalls 43 or a rear wall thereof. Each pocket 13 comprises a rear wall and a front wall 19. The front wall 19 comprises a transparent window 40 adapted to display the insert therethrough. The transparent window 40 is preferably rectangular in shape and comprises the same dimension as the dimension of the insert. However, in other embodiments, the transparent window 40 can be any suitable shape as long as the shape corresponds to that of the insert.

The rear wall of the pocket 13 is disposed within the interior of the secondary compartment 41 and is secured to the front wall of the pocket 13. The rear wall of the pocket 13 comprises an opening 15 adapted to provide access to the interior of the pocket and receive an insert therein. The opening 15 is disposed along the upper end of the rear wall. In some embodiments, the rear wall of the pocket 13 further comprises a top segment 52 and a bottom segment 50 having an opening therebetween, where the top segment 52 includes an overlapping portion extending over an upper end of the bottom segment 50 creating a flap over the opening. Thus, the insert is adapted to be removed from or placed in the pocket 13 through the upper end thereof. However, in other embodiments, the opening 15 can be disposed anywhere along the rear wall, including the lower end or sides thereof, as long as the opening 15 is capable of receiving the insert therein. The opening 15 may be closable by any suitable fastener, such as hook material 48 and loop material 49 or a zipper.

In some embodiments, the rear wall of the pocket 13 is rigid so as to provide support to the insert, such that the insert will not be bent or become disfigured by any objects disposed on the main or secondary compartments 34, 41 of the bag 12. In some embodiments, the pocket 13 comprises a planar member that is disposed against the rear wall thereof in order to provide additional rigidity and support thereto. The planar member is the same dimension as the dimension of the rear wall of the pocket 13. The opening 15 is adapted to allow the insert to be interchangeably disposed therein without having to bend or deform the insert.

Figure 2:
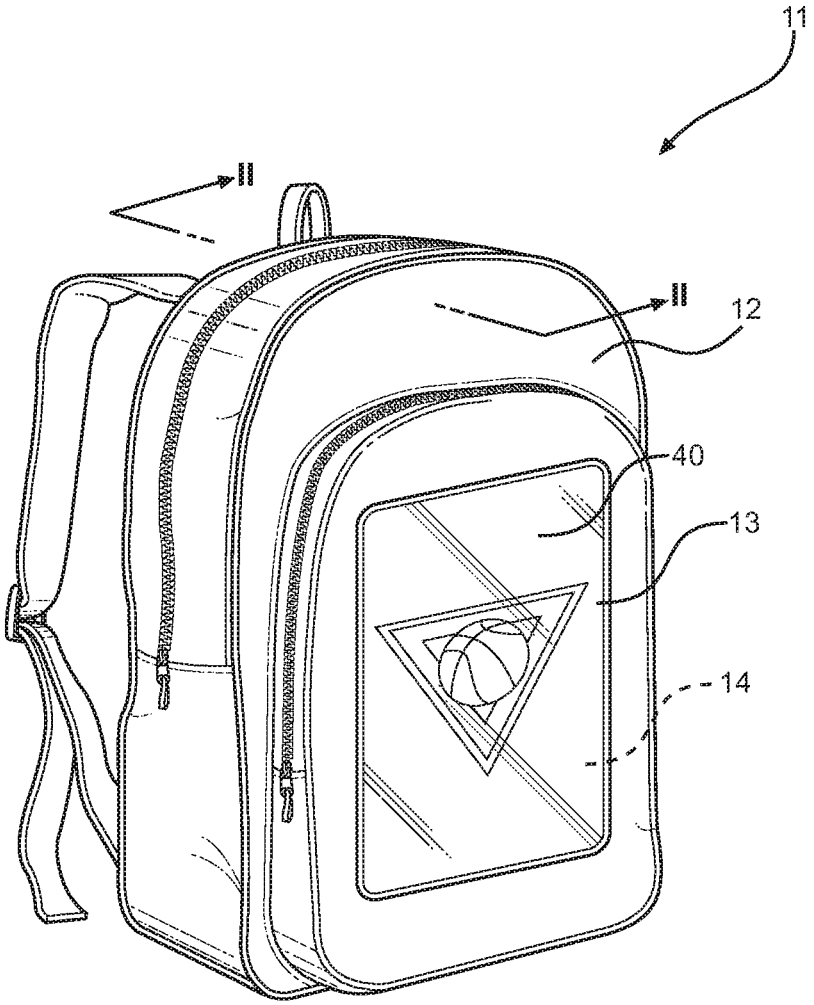
FIG. 2 shows a perspective view of an embodiment of the customizable bag wherein the insert is disposed in the pocket.
Figure 3:
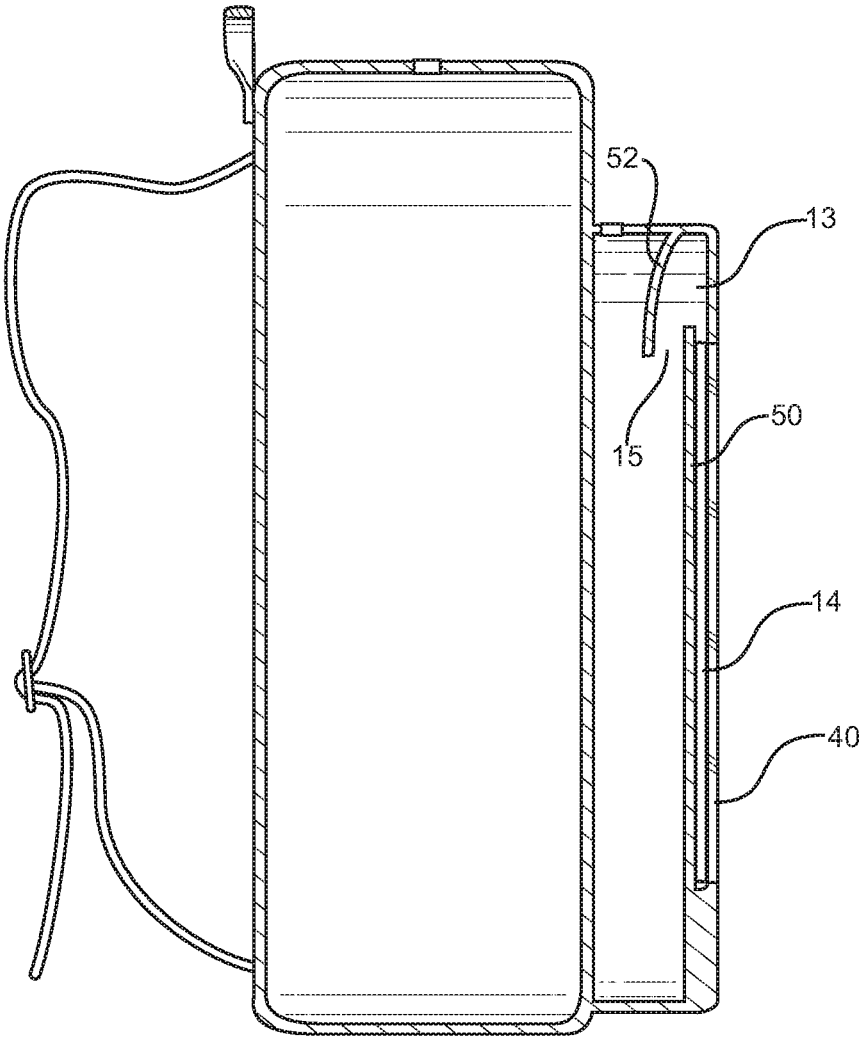
FIG. 3 shows a cross sectional view of the customizable bag taken along line II of FIG. 2 wherein the insert is disposed in the pocket.

Referring now to FIGS. 2 and 3, there is shown a perspective view of an embodiment of the customizable bag wherein the insert is disposed in the pocket and a cross sectional view taken along line II of FIG. 2 of the customizable bag wherein the insert is disposed in the pocket, respectively. The insert 14 comprises a planar section having a front surface and a rear surface. The insert 14 is preferably rectangular in shape so as to correspond to the shape of the transparent window 40. In other embodiments, the insert 14 comprises any shape corresponding to the shape of the transparent window 40. The front surface of the insert 14 comprises an image that is visible through the transparent window 40. In other embodiments, any suitable image can be displayed on the insert 14, including a holographic image, a raised image, and the like.

The insert 14 is disposed through the opening 15 disposed on the rear wall 50 of the pocket 13, wherein the opening 15 is then closed via a fastener. In the illustrated embodiment, one side of the opening comprises hook material and the opposing side of the opening comprises loop material, such that the opposing sides of the opening are removably secured to one another. The insert 14 is removably secured in position because it comprises a similar dimension to the pocket 13 so as to prevent movement within the pocket 13. In some embodiments, the insert 14 is no thicker than one inch.

Figure 4:
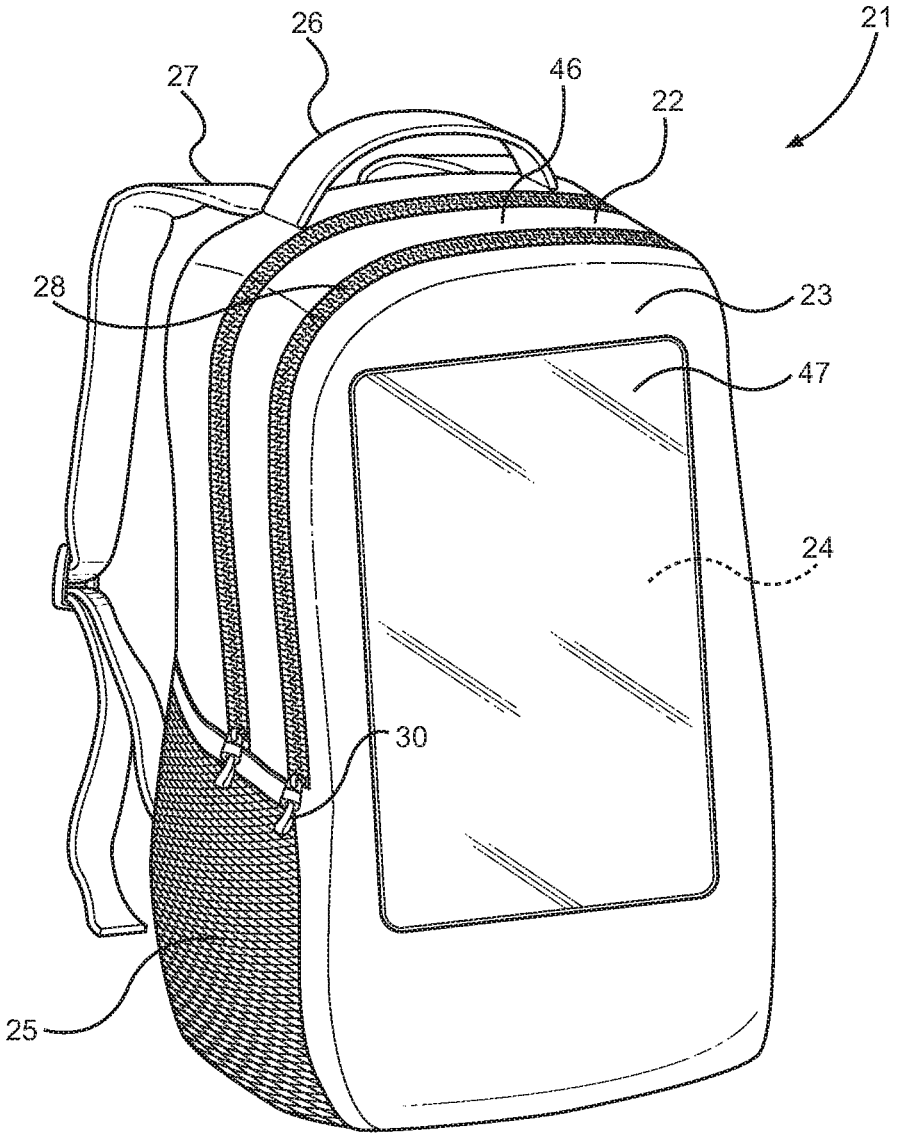
FIG. 4 shows a perspective view of an alternative embodiment of the customizable bag.
Figure 5:
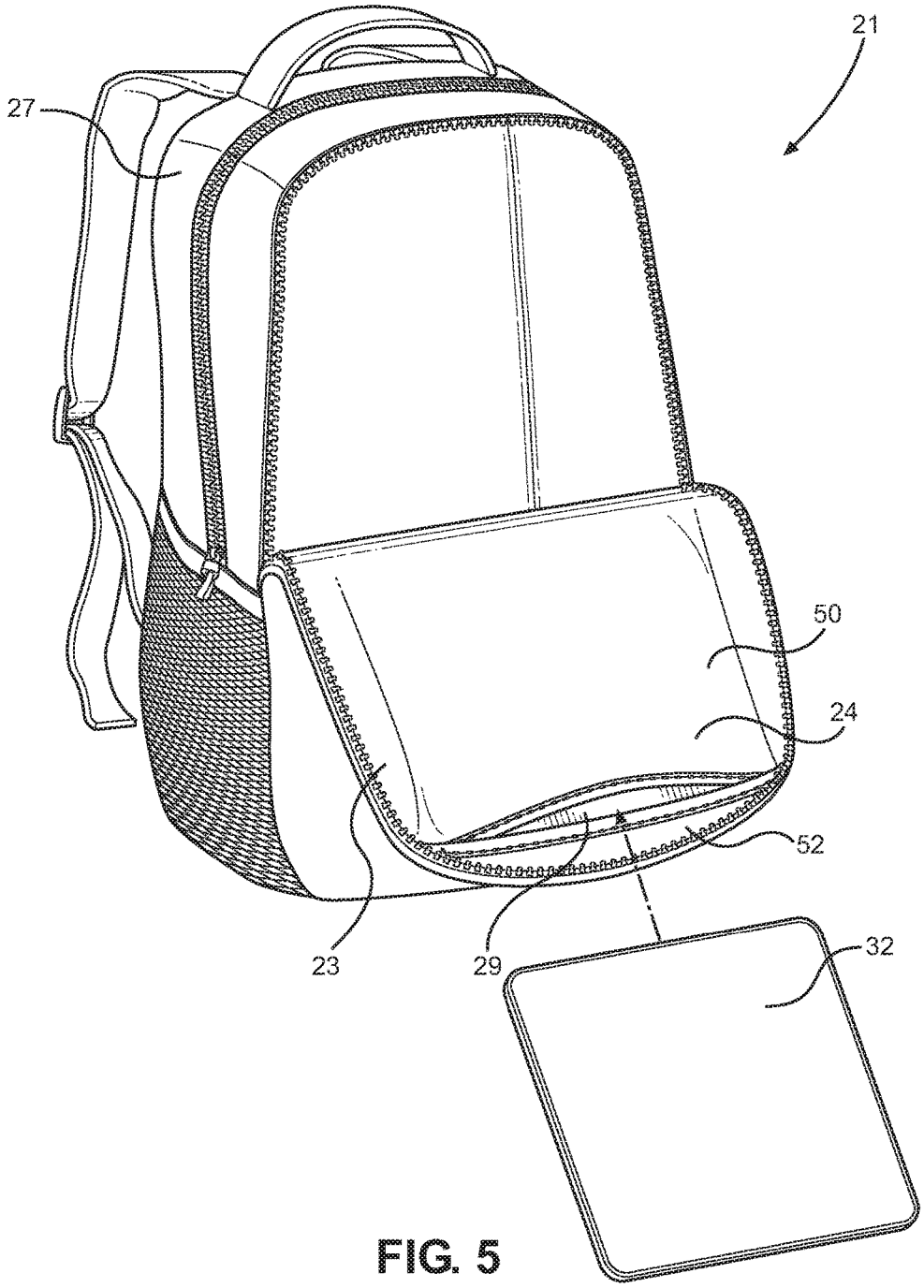
FIG. 5 shows a perspective view of an alternative embodiment of the customizable bag wherein an insert is positioned for insertion into the pocket.

Referring now to FIGS. 4 and 5, there is shown a perspective view of an alternative embodiment of the customizable bag and a perspective view of an alternative embodiment of the customizable bag wherein an insert is entering the pocket, respectively. The alternative embodiment comprises one or more pockets 23 adapted to receive an insert 32 therein, a secondary compartment 45 disposed on the front wall of the main compartment 46 of the bag 22, and one or more pouches 25, wherein the secondary compartment extends along the entire front wall of the main compartment. In the illustrated alternative embodiment, there is shown a pair of pouches 25 disposed on opposing sides of the bag 22, wherein each pouch 25 is mesh and comprises a base, one or more sidewalls, and an open upper end. The bag 22 further comprises a pair of shoulder straps 27 disposed on the rear wall thereof and a U-shaped handle 26 disposed on the upper end thereof.

In the illustrated embodiment, the pocket 23 comprises a front wall, a rear wall 24 having a top segment 52 and a lower segment 50, and an interior volume therein, wherein the transparent window 47 serves as the front wall of the pocket 23. The opening 29 is disposed between the rear wall 24 and the transparent window 47. The rear wall 24 of the pocket 23 is secured to and aligned with the rear side of the transparent window 47, with the exception of the opening 29 so that the pocket 23 can receive an insert 32 therein. The rear wall 24 directly secured to the transparent window 47 allows the insert 32 to align with and be displayed through the transparent window 47, rather than relying on the pocket 23 dimension to be similar to that of the insert 32 in order to hold the insert 32 in position. In the illustrated alternative embodiment, the upper end 29 of the rear wall 24 is open in order to receive the insert 32 therein. When disposing an insert 32 within the pocket 23, the user places the insert 32 into the upper 29 end of the pocket 23 and then closes the opening 28 of the secondary compartment. The opening 28 is closable by any suitable fastener, such as a water-resistant zipper 30.

It is therefore submitted that the instant invention has been shown and described in various embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A customizable bag, comprising:

a bag comprising a main compartment having a base, sidewalls, a front wall and an open upper end adapted to provide access to the main compartment;

a secondary compartment disposed on the front wall of the main compartment, the secondary compartment comprising a base, a front wall, sidewalls, an open upper end adapted to provide access to an interior of the secondary compartment, wherein the front wall of the main compartment serves as a rear wall of the secondary compartment;

wherein the base of the secondary compartment is raised relative the base of the main compartment;

wherein the sidewalls of the secondary compartment comprise a first sidewall disposed parallel to a second sidewall, the first sidewall and the second sidewall each extending from the base of the secondary compartment to a curved upper end;

a fastener disposed along the open upper end of the secondary compartment, the fastener extending along a midsection of the first sidewall, across the open upper end of the secondary compartment, and terminating at a midsection of the second sidewall;

a pocket disposed within the secondary compartment, wherein the pocket comprises a rear wall, a front wall, and an interior volume, wherein the rear wall of the pocket further comprises a top segment and a bottom segment having an opening therebetween, the top segment having an overlapping portion extending over an upper end of the bottom segment creating a flap over the opening, wherein the opening is adapted to receive an insert therein;

wherein the top segment and the bottom segment of the rear wall of the pocket are secured to the front wall of the secondary compartment and extend along an entire width thereof, such that the front wall of the secondary compartment serves as the front wall of the pocket;

a transparent window disposed on the front wall of the secondary compartment, wherein the transparent window is adapted to display the insert therethrough;

wherein the transparent window extends over the majority of a surface area of the front wall of the secondary compartment; and one or more pouches disposed on a side of the bag, wherein each pouch is mesh and comprises a base, one or more sidewalls, and an open upper end.

2. The customizable bag of claim 1, wherein the bag is a backpack.

3. The customizable bag of claim 1, further comprising a pair of shoulder straps.

4. The customizable bag of claim 1, wherein the fastener is a water-resistant zipper.

5. The customizable bag of claim 1, further comprising the insert, wherein the insert comprises a planar section and is adapted to be displayed through the transparent window.

6. The customizable bag of claim 5, wherein the insert is dimensioned to extend along the entirety of a width and a height of the interior volume of the pocket.

* * * * *